US006288621B1

(12) United States Patent
Rival

(10) Patent No.: US 6,288,621 B1
(45) Date of Patent: Sep. 11, 2001

(54) POLE FOR AN ELECTRICAL CIRCUIT BREAKER, EQUIPPED WITH A WIDE ARC EXTINGUISHING CHAMBER

(75) Inventor: Marc Rival, Panissage (FR)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 09/755,174

(22) Filed: Jan. 8, 2001

(30) Foreign Application Priority Data

Jan. 7, 2000 (FR) ..... 0000200

(51) Int. Cl.[7] ..... H01F 9/30; H01H 33/20

(52) U.S. Cl. ..... 335/201; 218/148; 218/156; 218/158

(58) Field of Search ..... 335/206; 218/15, 218/16, 18, 34, 35, 36, 38, 39, 40, 43, 44, 46, 47, 76, 81, 148, 149, 152, 156, 157, 158

(56) References Cited

U.S. PATENT DOCUMENTS 4,885,441 12/1989 Hisatsune et al. ..... 218/148
5,475,193 * 12/1995 Perdoncin ..... 218/34

FOREIGN PATENT DOCUMENTS 3142883 5/1983 (DE) .
0403328 12/1990 (EP) .
2604026 3/1988 (FR) .

* cited by examiner

*Primary Examiner*—Ramon M. Barrera
(74) *Attorney, Agent, or Firm*—Parkhurst & Wendel, L.L.P.

(57) ABSTRACT

An electrical circuit breaker pole comprises an arc extinguishing chamber with two side flanges, a rear wall, separators, a front opening, a lower arcing horn electrically connected to the stationary contact and an upper arcing horn. The rear part of the lower arcing horn is of large width. It is bordered by a periphery made of gas-generating material interposed between the edge of the rear part and the side flanges. This arrangement fosters breaking of arcs of weak intensity, in high voltage.

2 Claims, 4 Drawing Sheets

POLE FOR AN ELECTRICAL CIRCUIT BREAKER, EQUIPPED WITH A WIDE ARC EXTINGUISHING CHAMBER

BACKGROUND OF THE INVENTION

The invention relates to an arc extinguishing chamber of a low-voltage, high-current circuit breaker. For such circuit breakers, a particular difficulty is encountered when a current is required to be broken in a relatively high voltage, about 600 Volts rms single-phase or 1000 Volts rms three-phase, with a fairly low intensity of about 5 to 10 times the rated current of the circuit breaker.

The document EP 0,306,382 describes a multipole circuit breaker with a molded insulating case meeting this requirement, housing an operating mechanism coupled to a switching bar so as to perform opening and closing of all the poles of the circuit breaker. Each pole comprises a stationary contact means, a movable contact means and an arc extinguishing chamber. The stationary contact means comprise a fixed conducting current input strip supported by the back-plate of the case, stationary main contacts and a stationary arcing contact. The movable contact means comprise a fixed conducting current input strip also supported by the back-plate of the case, and a contact system having a plurality of identical main contacts arranged in two series of the same number on each side of a movable arcing contact extending longitudinally along the center axis of the pole, the length of the movable arcing contact being greater than the length of the movable main contacts. The arc extinguishing chamber is arranged above the first strip and comprises a stack of separators formed by metal arc deionization plates, each plate having a V-shaped notch. A pair of arcing horns, one lower and one upper, are located on each side of the stack of plates of the extinguishing chamber. The lower arcing horn is fixedly secured to the top face of the first strip, with an insulating shield arranged between these two elements, by means of three screws which ensure flow of the current between the arcing horn and the strip. The three screws are arranged at the apexes of an isosceles triangle, one of the screws being arranged along the center axis of the pole near to an edge of the insulating shield and of a wall for outlet of the breaking gases to the outside, and the other two screws being located near to the stationary main contacts. The width of the lower arcing horn decreases in the direction of migration of the arc towards the center screw, and the other two screws are located on each side of the stationary arcing contact and near to the corresponding stationary main contacts. When opening of the contacts takes place, the arc arises in the arcing contact separation zone situated along the center axis of the pole and subsequently develops in the center zone of the chamber. The arc migrates to the center screw which stabilizes the arc root. At the end of opening travel, the distance between the arcing contacts becomes greater than the distance between the main contacts, causing a new breakdown of the arc at the level of the main contacts on one of the sides of the chamber. The arc then develops on a second different path along one of the sides of the chamber, recentering progressively and encountering along its path cold surfaces where efficient absorption fostering extinguishing of the arc takes place.

In such a device, a large part of the chamber is used for extinguishing the arc. However, it is observed that one of the sides of the chamber remains largely unused, as after breakdown of the arc, the arc only develops on one of the sides of the chamber. The depth of the chamber, i.e. its longitudinal dimension between the entrance of the chamber and the gas outlet wall, must be sufficient to cope with the volume of energy exchange necessary for arc extinguishing. It is however desirable, for a circuit breaker of given performances, that the depth of the chamber be reduced, while keeping the same width, which is a dimension imposed in practice by fitters' standards of user.

The document FR 2,604,026 furthermore describes a circuit breaker wherein the lower arcing horn broadens out from its front part near the contacts to its rear part near the back-plate of the arc extinguishing chamber. The broadened rear part constitutes a collecting part of smaller surface than the cross-section of an arc root for an arc formed with a constant electrical current density corresponding to the rated breakdown current. The objective here is to direct the arc onto the collecting part and to stabilize it there. The stabilized arc then develops essentially in the center part of the chamber. Such a configuration is only efficient if the longitudinal dimension of the chamber, i.e. its depth between the stationary contact zone and the rear wall of the chamber performing removal of the gases is large. The width of the chamber can be reduced as it is not used for arc extinguishing.

OBJECT OF THE INVENTION

The object of the invention is to improve the performances of a multipole low-voltage, high-current circuit breaker in particular a circuit breaker having to be suitable for breaking a rated current greater than 1000 amps rms, at high voltage of about 600 Volts in rms value per phase. Its object is notably to reduce the volume of the chamber necessary to guarantee breaking of a current at high voltage, by reducing the depth of the chamber for a given width. Its object is more precisely to use the volume of the chamber to the full when the chamber is wide and of small depth and/or reduced height.

According to the invention, this objective is achieved by means of a pole for an electrical circuit breaker comprising a case and an operating mechanism able to switch from a closed position to an open position, said pole comprising:

- a stationary contact means made of conducting material comprising a contact zone,
- a movable contact means comprising one or more contact fingers made of conducting material, the movable contact means being able to be coupled to said mechanism and to switch from a closed position in which the contact finger or fingers are in contact with the contact zone of the stationary contact means to an open position where the two contact means are separated,
- an arc extinguishing chamber comprising:
  - two parallel side flanges made of insulating material situated at equal distance from a geometric longitudinal mid-plane of the chamber, the longitudinal mid-plane thus bounding two geometric lateral half-spaces each containing one of the side flanges,
  - a rear wall comprising one or more gas outlet orifices,
  - separators formed by metal plates extending from one of the side flanges to the other, appreciably perpendicularly to the longitudinal mid-plane,
  - a front opening situated near to the contact zone of the stationary contact means and facing the rear wall,
  - a lower arcing horn made of conducting material, electrically connected to the stationary contact means, comprising:
    - a rear part situated near to the rear wall and comprising an edge,
    - an intermediate part joining the contact zone and the rear part, a back-plate made of insulating material, an upper arcing horn made of conducting material, the separators being situated between the lower arcing horn and the upper arcing horn, wherein:

the rear part has a width, measured parallel to an axis perpendicular to the longitudinal mid-plane, which is greater than the width of the intermediate part measured parallel to the same axis, in each of the lateral half-spaces, the rear part of the arcing horn has at least one point situated with respect to the side flange situated in the half-space involved at a distance which is smaller than a quarter of the distance between the two side flanges, the distance between the rear part and each of the side flanges is smaller than half the distance between each of the side flanges and the mid-plane, the back-plate comprises a periphery made of gas-generating material interposed between the edge of the rear part and the side flanges.

With a device of this type, after a test involving breaking of a current less than 10 times the rated current with an AC voltage exceeding 600 Volts in single-phase rms value, it is observed that the lower arcing horn is solicited to the same extent on the two most lateral parts of the rear end zone. This makes it possible to affirm, although the theoretical bases of the explanation are still not very precise, that the two lateral parts of the chamber have contributed in very close proportions to absorption of the energy given off by the arc, and therefore to extinguishing of the arc. In fact it is difficult to say whether the traces observed are due to the existence of two arcs developing simultaneously in the chamber or whether they are due to a high-speed lateral oscillation of the arc from one side of the rear end zone of the arcing horn to the other. This arrangement does nevertheless enable the available width of the chamber to be used to the full, and therefore breaking of a high voltage arc, above 600 Volts rms for the phase involved, to be achieved with a chamber of small depth.

The invention finds a particularly effective application in terms of volume reduction if, in each part of the chamber bounded by the longitudinal mid-plane, said point is also situated with respect to the rear wall at a distance which is smaller than a quarter of the distance between each of the side flanges. This then assures that the arc will use the volume of material constituted by the separators to the fill.

The invention applies preferably to a pole of relatively large width, in particular a pole wherein the distance between the contact zone of the stationary contact means and the rear wall of the chamber is smaller than the distance between the side flanges of the chamber. It also applies to a pole wherein the lower arcing horn has a length, measured in the longitudinal mid-plane, which is smaller than the largest width of the rear part of the arcing horn measured along an axis perpendicular to the longitudinal mid-plane.

The metal plates of the separators preferably have a front edge comprising a dissymmetric notch directed towards one or the other of the side flanges.

Preferably the periphery protrudes out towards the inside of the chamber with respect to the rear part of the arcing horn or is flush with the rear part of the arcing horn. The protruding periphery enables a considerable gas removal to be achieved, which contributes greatly to creating the effect sought for of development of two parallel arcs or of an arc oscillating from side to side in the two lateral parts of the chamber.

According to one embodiment of the invention, it is considered that:

each lateral half-space comprises a part of the separators, this part of the separators having a geometric barycenter, in each lateral half-space, the distance between the first end zone and the side flange contained in the half-space is smaller than the distance between the barycenter situated in the same half-space and said side flange.

BRIEF DESCRIPTION OF THE DRAWINGS

Other advantages and features of the invention will become more clearly apparent from the following description of different embodiments of the invention given as non-restrictive examples only and represented in the accompanying drawings in which.

DETAILED DESCRIPTION OF THE PREFERRED EMBODIMENTS

Figure 1:
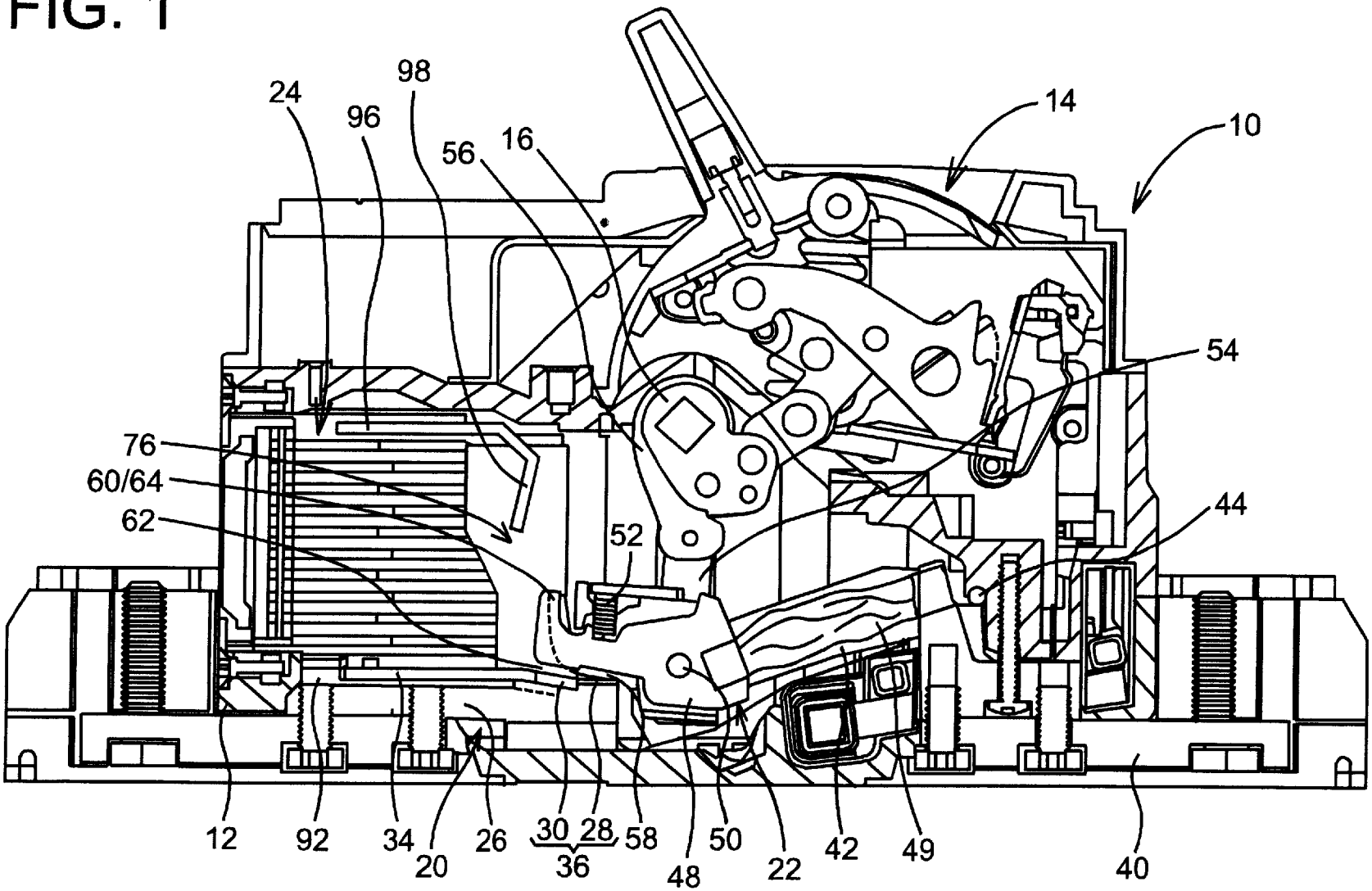
FIG. 1 represents a view of a pole of a switchgear apparatus according to a first embodiment of the invention, in cross-section along a longitudinal mid-plane of an arc extinguishing chamber of this pole.
Figure 2:
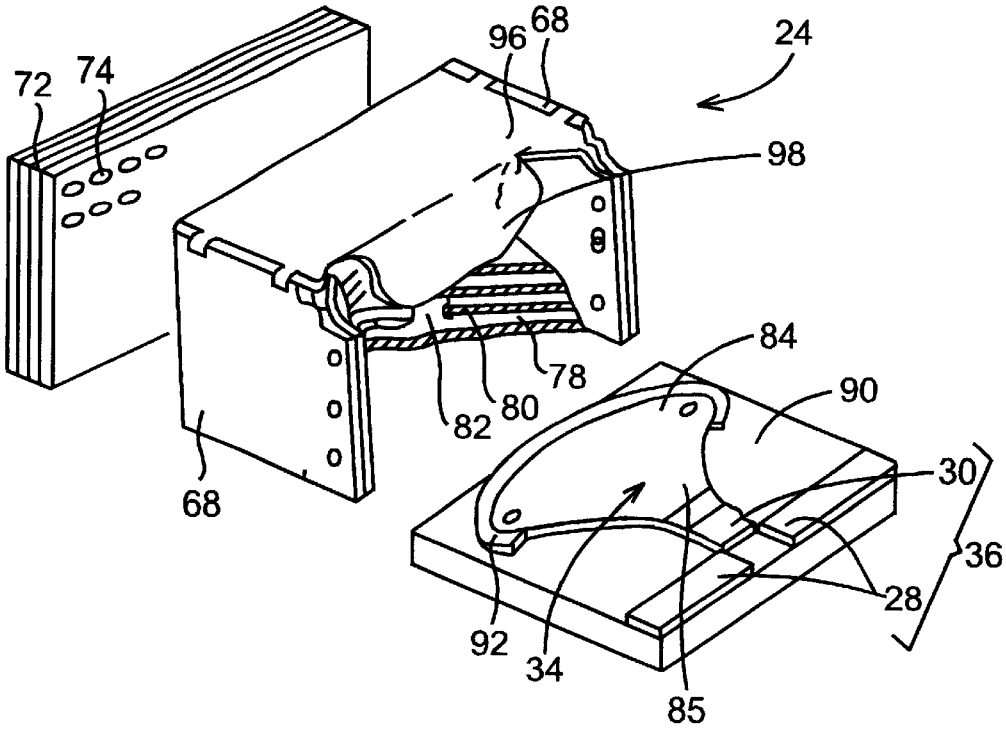
FIG. 2 represents an exploded perspective view of a part of the pole of FIG. 1, showing in particular the arc extinguishing chamber.
Figure 3:
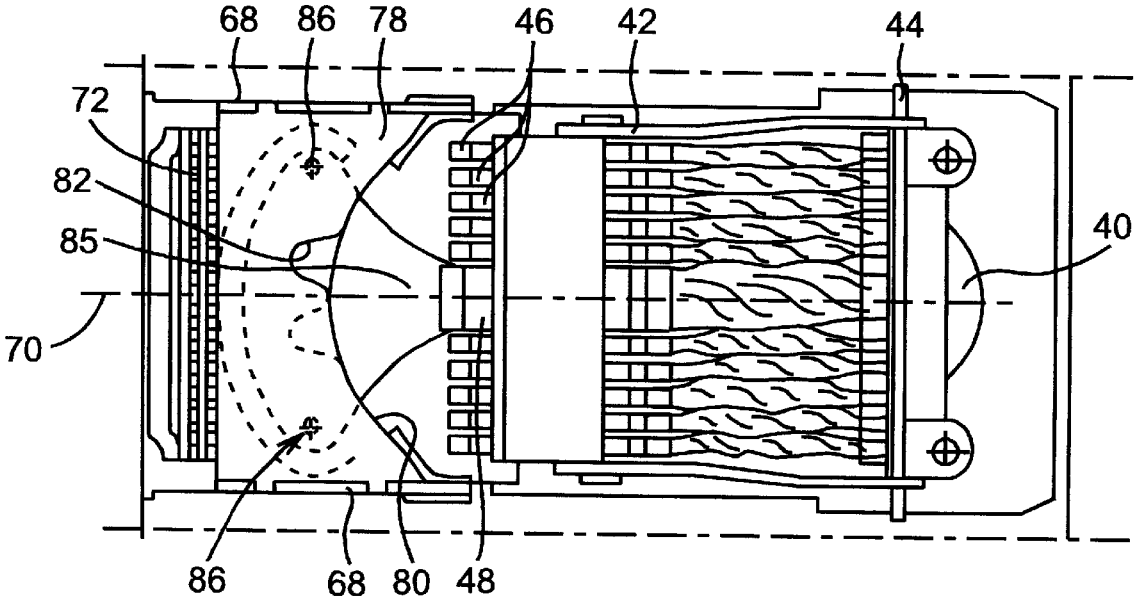
FIG. 3 represents a top view of the pole of FIG. 1.

With reference to FIGS. 1 to 3, a low-voltage multipole power circuit breaker 10 comprises an insulating case 12 housing an operating mechanism 14 of known type, equipped with a transverse switching bar 16 common to all the poles, turning in bearings arranged in the case 12. Each pole comprises a stationary contact means 20, a movable contact means 22 and an arc extinguishing chamber 24 situated near to the stationary contact means 20.

The stationary contact means 20 comprise a current input strip 26 mounted on the back-plate of the case 12, partly under the arc extinguishing chamber 24. The stationary contact means 20 comprise in addition two main contact blocks 28 (FIG. 2) fixed directly to the current input strip 26 and a central arcing contact 30. The arcing contact 30 is fixed to the current input strip 26 in an intermediate zone between the blocks 28 and the chamber 24. The arcing contact 30 is extended towards the inside of the chamber 24 by a conducting lower arcing horn 34 described in detail further on. The current input strip 26, blocks 28, arcing contact 30 and arcing horn 34 are made of various conducting materials and are at the same potential. The arcing contact 30 and blocks 28 together form a contact zone 36 designed to perform the electrical contact with the movable contact means 22.

The movable contact means 22 comprise for their part a fixed conducting current input strip 40, a support cage 42 pivotally mounted around an axis 44 fixed with respect to the case 12, and a plurality of main contact fingers 46 (FIG. 3) placed on each side of a central arcing contact finger 48. The contact fingers 46, 48 pivot around a common geometric axis 50, fixed with respect to the cage 42, and are biased towards the stationary contact means 20 by contact pressure springs 52. A connecting rod 54 performs the coupling between the cage 42 of the movable contact means 22 and a crank 56 of the switching bar 16 of the mechanism 14. Each main finger 46 comprises a contact pad 58 designed to perform the contact with the corresponding contact block 28 of the stationary contact means 20 when the apparatus is in the closed position represented in FIG. 1, and a spigot 60 protruding out beyond the contact pad in the direction of the arc extinguishing chamber 24. The arcing contact finger for its part has a movable arcing contact 62 designed to perform contact with the stationary arcing contact 30 of the stationary contact means 20 when the apparatus is in the closed position represented in FIG. 1, and a spigot 64 protruding out beyond the contact pad in the direction of the arc extinguishing chamber 24 with an identical shape to that of the spigots 60. The contact fingers 46, 48 are electrically connected to the current input strip 40 by means of braids 49.

The arc extinguishing chamber 24 comprises two side flanges 68 made of insulating material, which are parallel to the cross-sectional plane of FIG. 1 and situated at equal distance on each side of the latter, so that the cross-sectional plane constitutes a geometric longitudinal mid-plane 70 of the chamber 24 and of the pole. A rear wall 72 for outlet of the gases is arranged at the rear of the chamber, perpendicularly to the side flanges 68. This wall 72 comprises one or more orifices 74 for outlet of the breaking gases. A front opening 76 is arranged near to the contact zone 36, opposite from the rear wall 72. Separators 78 formed by flat metal plates extend perpendicularly to the longitudinal mid-plane 70 from the front opening 76 to the rear wall 72. The separators 78 are arranged at a distance from one another so as to leave the possibility of a gas flow between the front opening 76 and the rear wall 72. The separators are supported laterally by the side flanges 68. Each plate 78 has an front electric arc pick-up edge 80 which presents a curved concave U-shape or V-shape approximately in the plane of the plate, with a narrower dissymmetric notch 82. The separators 78 are stacked so that the notches 82 are alternately on one and the other lateral side of the chamber 24.

The lower arcing horn 34, designed to receive the arc root when the arc extends from the stationary arcing contact 30 towards the inside of the chamber 24, comprises a rear part 84 situated inside the chamber, and an intermediate part 85 joining the rear part to the stationary arcing contact 30. The width of the rear part 84, i.e. its largest dimension measured along an axis perpendicular to the longitudinal mid-plane 70 of the chamber, is large whereas the intermediate part 85 constitutes a narrower section. The rear part 84 presents two lateral surfaces forming receiving areas 86 for the root of an electric arc developing in the chamber 24.

The distance between the receiving area 86 and the side flange situated in the same half-space bounded by the longitudinal mid-plane 70 is smaller than half the distance between the flange 68 and the mid-plane 70, and therefore smaller than a quarter of the width of the chamber measured between the flanges 68. The receiving areas 86 are also relatively near to the rear wall 72 of the chamber. In other words, the lower arcing horn 34 comprises in its rear part 84 and on each lateral side of the chamber at least one point situated, with respect to the side flange situated on the same side of the chamber, at a distance smaller than a quarter of the width of the chamber 24 and situated, with respect to the rear wall 72, at a distance smaller than a third or a quarter of the width of the chamber 24.

The lower arcing horn 34 is fixed to a back-plate 90 made of insulating material, in this case 6—6 polyamide 30% charged with glass fiber. The part of the plate 90 not covered by the arcing horn extends up to the flanges 68 and the rear wall 72, and presents a periphery 92 forming a shoulder protruding out into the chamber and coming flush with the periphery of the rear part 84 of the arcing horn. Alternatively, the periphery 92 can protrude towards the inside of the chamber up to a height greater than that of the rear part 84 of the arcing horn. The periphery 92 has a rounded C-shape which has exactly the same shape as the edge of the rear part 84, and in particular of the receiving areas 86, so as to constitute a separation between the rear part 84 and the rear wall 72 of the chamber on the one hand, and between the rear part 84 and the side flanges 68 on the other hand. The rear part 84 of the arcing horn is electrically connected to the current input strip 26 by means of the arcing contact 30 only, and the plate 90 forms a continuous solid insulator between the rear part 84 and the strip 26.

An upper arcing horn 96, designed to receive the head of the arc at the end of opening of the movable contact means 22, is formed by a metal plate perpendicular to the longitudinal mid-plane 70, supported by the side flanges. The upper arcing horn 96 is appreciably parallel to the separators 78 in its rear part and comprises in its front part a flap 98 which at least partially encloses the separators 78 situated in the upper part of the chamber.

Operation of the device according to the first embodiment is as follows:

In the closed position, the switching bar 16 is locked by the mechanism 14, and keeps the cage 42 in the position illustrated in FIG. 1. The springs 52 provide a contact pressure between the pads 58 of the main contact fingers 46 and the contact blocks 28, and also between the contact 62 of the arcing contact finger 48 and the stationary arcing contact 30.

On detection of a weak fault current, an electronic trip device acts on the mechanism 14 which causes opening. Rotation of the switching shaft 16 makes the cage 42 pivot around its rotational axis 44. The main contact fingers 46 pivot very slightly around the rotational axis 50, counter-clockwise in FIG. 1, due to the effect of the contact pressure springs 52, while remaining in contact with the blocks 28. They then come up against a stop of the cage 42 and are driven fixedly with the cage 42 in clockwise rotation around the rotational axis 44 so that they separate from the blocks 28. As far as the principle is concerned, the movement of the arcing contact finger 48 is similar, but staggered in time due to the spatial offset between the blocks 28 and the stationary arcing contact 30. Thus, when separation of the main contact fingers 46 takes place, the arcing contact finger 48 is still in contact with the stationary arcing contact 30. The whole of the current flowing between the strips 26, 40 then flows via the arcing contacts 30, 62. In a second phase, the arcing contact finger 48 in turn comes up against a stop of the cage 42 which drives it fixedly with the cage 42 in the clockwise rotational movement of the latter around the rotational axis 44 of the cage, so that separation of the arcing contact finger 48 and of the stationary arcing contact 30 takes place. An arc then forms between the arcing contacts 30. On account of the current loop formed in the strip 26 and the plate 32, the arc root quickly migrates to the back of the chamber 24, whereas the head of the arc remains on the spigot 64 of the contact finger 48. When the mechanism reaches the open position, the contact fingers 46, 48 are located near to the flap 98 of the upper arcing horn. The arc head then switches onto the upper arcing horn 96 and a secondary arc forms in series with the first arc, between the flap 98 and the spigot 94 of the arcing contact finger 48. On entering the chamber 24, the arc divides more or less on contact with the separators 78 into elemental arcs, each elemental arc forming an electrical serial connection between two adjacent separators 78 or between each arcing horn 34, 96 and the separator 78 facing it.

When the arc root reaches the rear part of the chamber 24, it tends to move towards one or the other of the lateral receiving areas 86 of the lower arcing horn. When it is established on one of the lateral receiving areas 86, the arc root causes ablation of the edge of the periphery 92 made of gas-generating material with a large emission of gas, in particular hydrogen. This gas emission in the immediate proximity of the arc root causes a constriction of the arc root and prevents the latter from stabilizing definitively on the lateral receiving area 86 involved.

The next phase of arc development and extinguishing is not perfectly known due to the fact that observation means are limited and that the theory does not allow a complete explication of the observed results to be given. It is in fact observed that after the arc has been extinguished the two lateral receiving areas 86 of the rear part 84 of the arcing horn bear similar traces, with a wear significantly greater than the wear of the other parts of the arcing horn 34. This makes it possible to affirm that the two lateral receiving areas have been exposed in privileged manner to an electric arc, in proportions very close to one another. Two hypotheses can be put forward: according to a first hypothesis, the arc root situated on one of the receiving areas 86 is expelled due to the gas emission by the periphery 92, and migrates laterally to the other receiving area 86 where the same phenomenon is reproduced, so that an oscillating movement of the arc root is seen to take place between the two lateral receiving areas 86. According to another hypothesis, the gas emission causes a striction of the arc root such that a new breakdown takes place at the level of the other receiving area 86, the two arcs subsequently continuing to exist in the chamber. The presence of two simultaneous arcs in parallel in a chamber being in general a very unstable transient phenomenon which is resolved by extinguishing of one of the two arcs, we suggest that, in this instance, an oscillation in phase opposition of the current densities of the two arcs is exceptionally caused, notably due to the effect of gas emission close to each arc which would tend to constrain the arc of higher current density to a greater extent.

In fact, in the absence of visualization tests with an ultra-fast camera, it is not possible to determine with exactitude which of the two hypotheses is correct. The determining fact is that use of the whole of the chamber and a balanced energy distribution between the two lateral receiving areas 86 is obtained by the combination of the two lateral receiving areas 86 and of a gas-generating periphery 92.

It should be emphasized that this phenomenon is only significant for breaking of low intensity currents in high voltage. When breaking high intensity currents in low voltage is involved, the arc invades the whole of the chamber in conventional manner.

Figure 4:
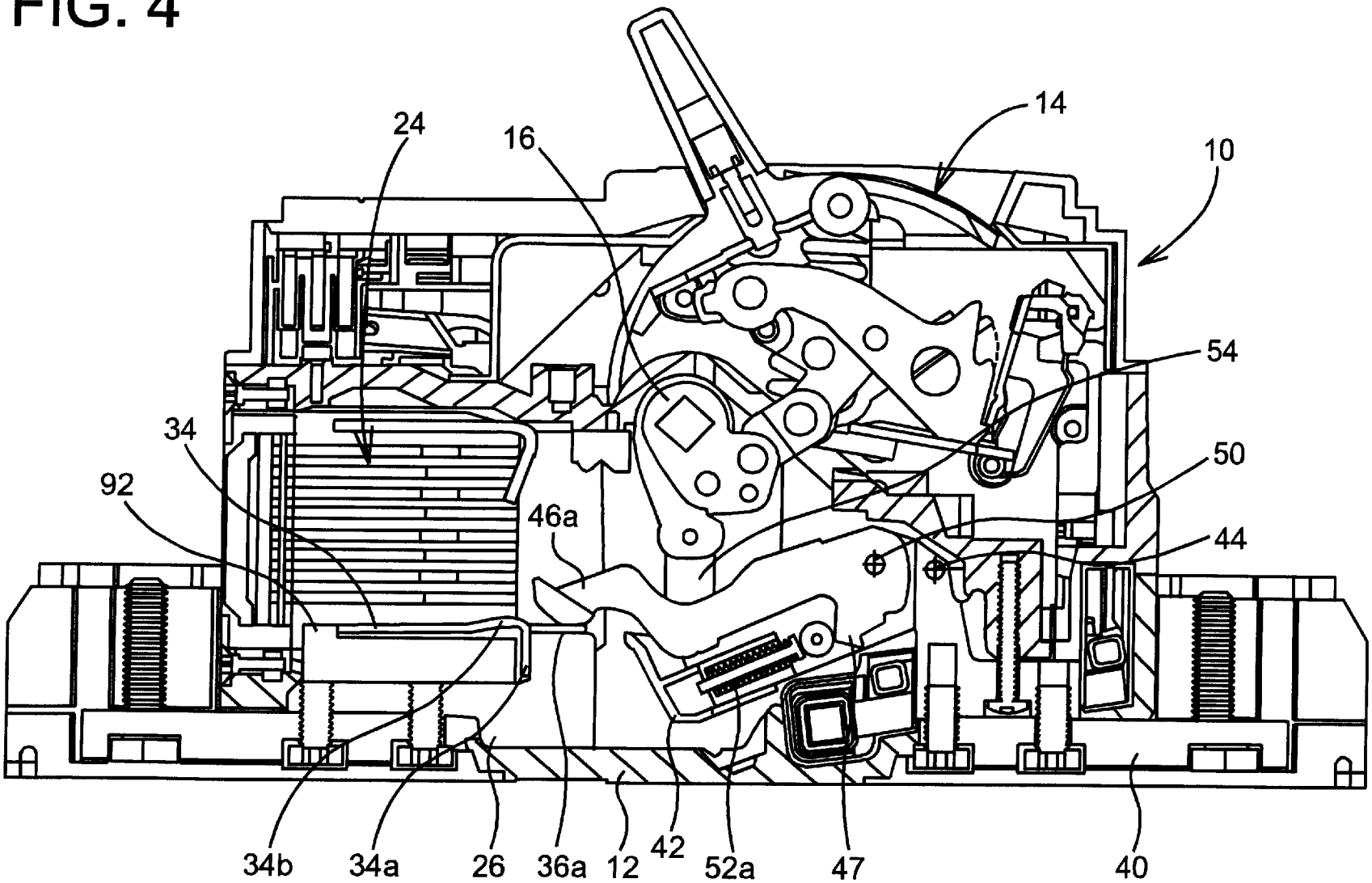
FIG. 4 represents a view of a pole of a switchgear apparatus according to a second embodiment of the invention, in cross-section along a longitudinal mid-plane of an arc extinguishing chamber of this pole.
Figure 5:
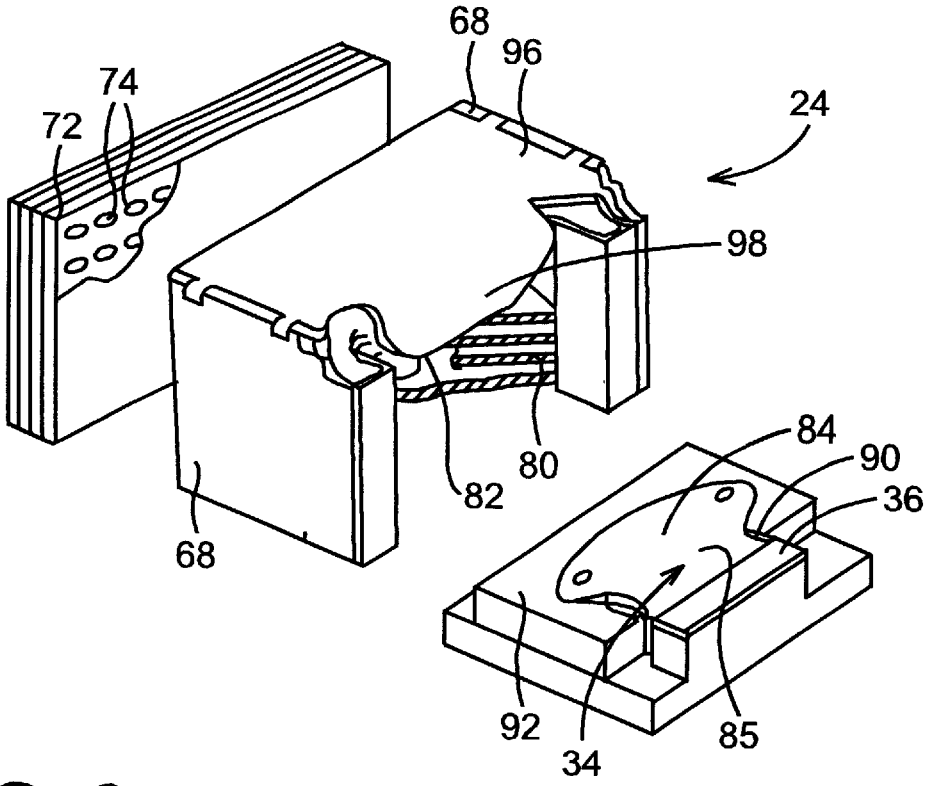
FIG. 5 represents an exploded perspective view of a part of the pole of FIG. 4, showing in particular the arc extinguishing chamber.
Figure 6:
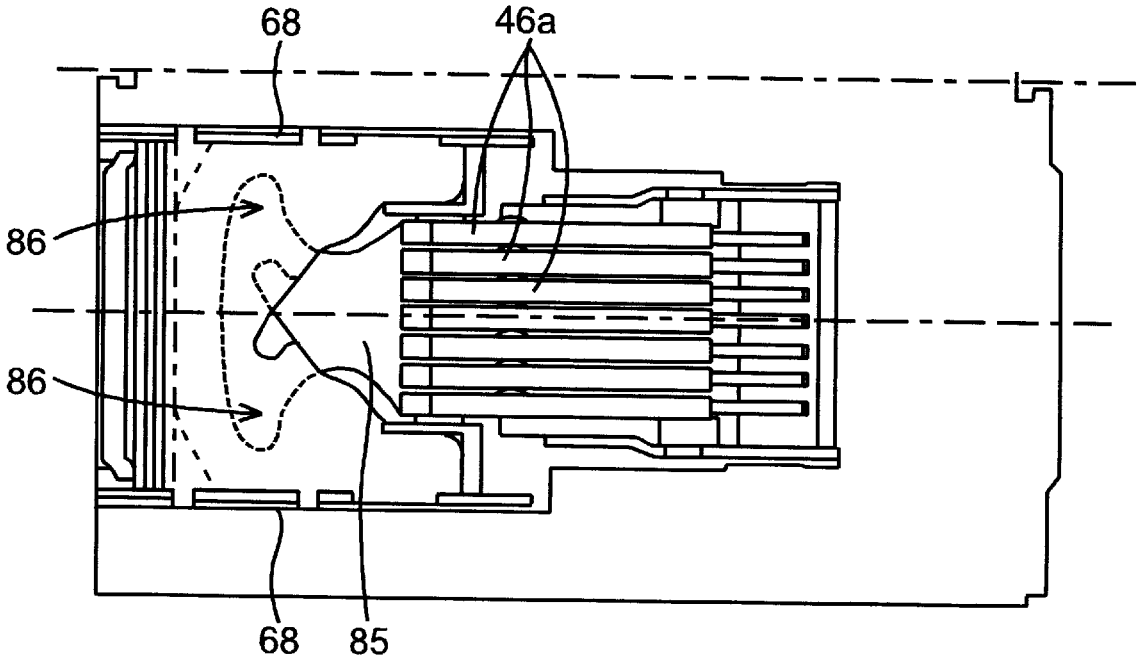
FIG. 6 represents a top view of the pole of FIG. 4.

With reference to FIGS. 4 to 6 a circuit breaker pole according to a second embodiment of the invention is presented. For the sake of simplifying the description, the reference signs used in the description of the first embodiment are used again for similar parts.

The circuit breaker 10 is housed in a case 12 and comprises as previously a mechanism 14 including a transverse switching bar 16 formed by a pivoting shaft common to all the poles of the circuit breaker. Each pole comprises a stationary contact means 20, a movable contact means 22 and an arc extinguishing chamber 24.

This circuit breaker differs essentially from the previous one by the absence of arcing contacts. The fixed current input strip 26 comprises a single contact block 36*a* which operates in conjunction with contact fingers 46*a*, all of which are identical, of the movable contact means 40. The end of the contact fingers 46*a* situated near to the rotational axis 50 comprises a cam 47 operating in conjunction with an elastic energy storage means 52*a* supported by the support cage 42 so as to form a bistable mechanism 53 designed to bias the fingers 46*a* either towards the fixed strip 26, or opposite from this strip. Operation of the bistable device 53 is described in detail in the French Patent Application bearing the registration number FR 9,905,276. The contact fingers 46*a* are electrically connected to the current input strip 40 by means of a braid.

A lower arcing horn 34 formed by a conducting metal plate is fixed by a front part to the strip 26 of the stationary contact means 20. The front part 34*a* of the lower arcing horn situated near to the contact block 36*a* comprises a contact area for contact with the current input strip 26 and is affixed to the latter. The front part also comprises a transverse edge 34*b* protruding slightly above the surface of the contact block 36 in the direction of the contact fingers 46*a*. The lower arcing horn 34 comprises in addition a rear part 84, extending inside the chamber, presenting a large width, the width being the largest dimension measured along an axis perpendicular to the longitudinal mid-plane of the chamber. The front part 34*a* and rear part 84 are joined by an intermediate part 85 of a width smaller than that of the rear part. As in the first embodiment, the rear part 84 constitutes two lateral arc receiving areas 86.

The back-plate of the chamber is formed by a plate 90 made of insulating material. The plate comprises a mould corresponding to the shape of the lower arcing horn and in which the arcing horn 34 is housed. The part of the plate not covered by the arcing horn constitutes a periphery 92 protruding out with respect to the back of the mould, which is flush with the upper edge of the rear part 84 of the arcing horn 34. This periphery is interposed on the one hand between the edge of the arcing horn 34 and the rear wall of the chamber, and on the other hand between the edge of the arcing horn 34 and the side flanges of the chamber. The whole of the plate, and in particular the periphery 92, is made of a gas-generating material, in this case 6—6 polyamide 30% charged with glass fiber.

Operation of the device according to the second embodiment of the invention is as follows:

Separation of the contacts can take place either due to electromagnetic repulsion of the fingers 46*a* which pivot clockwise with respect to the cage 42 beyond the dead point position of the bistable mechanism 53 until they reach an end-of-travel position, or following an opening order which causes opening of the mechanism 14, pivoting of its switching bar 16 and, by means of the connecting rod 54, pivoting of the cage 42 around its axis 44 in the clockwise direction in FIG. 1, which drives the fingers 46*a*.

The contact fingers 46*a* separate simultaneously with formation of an arc between one of the fingers 46*a* and the contact block 36*a*. Due to the electrodynamic current loop effect in the stationary contact means 20, the root of the arc migrates immediately onto the edge 34*b* of the front part of the lower arcing horn and then into the chamber 24. When passing via the narrowest intermediate part of the arcing horn, the root is recentered with respect to the mid-plane 70.

The subsequent stages of breaking are similar to those of the first embodiment.

Each of the embodiments therefore enables us to observe the existence, after breaking of a current of high voltage and moderate intensity, of two traces of arc roots at the level of the lateral receiving areas of the rear part of the lower arcing horn, bearing witness to the presence of an arc in each lateral part of the chamber. Owing to the lack of a theoretical basis to explain the reproducible result obtained, characterization of the shape of the rear part of the lower arcing horn can only be empirical.

To situate the relative position of the rear part of the lower arcing horn and of the separators more precisely, the two side halves of the chamber each situated in one of the two half-spaces bounded by the longitudinal mid-plane have to be considered separately. It is then possible to define a center of gravity for each separator part situated in the half-space in question. Each of the centers of gravity involved is nearer to the side flange situated in the half-plane involved than to the longitudinal mid-plane, due to the indentation formed by the U-shaped edge of the separators. By joining the centers of gravity obtained in one half-chamber together, a broken line is obtained all the points of which line are nearer to the corresponding side flange than to the longitudinal mid-plane. By determining the center of gravity of the previous centers of gravity, in other words the barycenter of the points constituting the centers of gravity each ponderated by the corresponding mass of the separator, a barycenter or global center of gravity of the material sub-assembly formed by the part of the separators contained in the half-space involved is also obtained, nearer to the side flange than to the longitudinal mid-plane.

To use a half of the chamber to the full, it is empirically sought to enable the arc root to be stabilized near to the previously defined broken line. Indeed, if the arc encounters each separator near to its center of gravity, it causes relatively uniform heating of the separator, and therefore results in a large thermal absorption.

The rear part of the arcing horn consequently comprises an arc root receiving area formed by a swelling situated approximately in the extension of the previously defined imaginary broken line. This result can be achieved by making a straight line, drawn from the previously defined global center of gravity and perpendicular to the plane of the upper surface of the end of the arcing horn, meet the arcing horn at the location of the receiving area.

In the same spirit, the condition can be imposed whereby the distance between the receiving area and the side flange situated in the half-space involved is smaller than the distance between the global center of gravity and the side flange. The condition can also be added whereby the distance between the receiving area and the rear wall of the chamber is greater than the distance between the global center of gravity and the rear wall.

Empirically, a good positioning of the receiving areas is obtained by imposing the condition that the distance between the receiving area and the side flange situated in the half-space involved be smaller than half the distance between the flange and the mid-plane, and therefore less than a quarter of the width of the chamber measured between the flanges. In other words, the lower arcing horn comprises, for each lateral half of the chamber, at least one point situated, with respect to the flange situated in the half chamber involved, at a distance less than a quarter of the width of the chamber. It can be added that this point is also situated, with respect to the rear wall of the chamber, at a distance less than a third or a quarter of the width of the chamber, to characterize the fact that the rear part of the arcing horn is really involved. However, the distance between the lower arcing horn and the rear wall of the chamber is in itself less critical.

Furthermore, it is necessary to emphasize the role of the narrow intermediate part 85 of the lower arcing horn, which enables the arc root to be centered when the arc migrates to the back of the chamber and which, once the arc root has reached the rear part 84, tends to prevent the arc root from returning to the contact zone.

Naturally, various modifications are possible.

In the embodiments presented, the arc always arises at the level of the contact zones, and then migrates onto the arcing horns. However, the invention also applies to a circuit breaker arranged in such a way that the arc arises directly between the lower arcing horn and the end of the contact fingers.

In the embodiments presented, the back-plate of the chamber and the gas-generating periphery constitute a single part made of gas-generating material. It can however also be envisaged to fit a separate periphery made of gas-generating material onto a non gas-generating insulating back-plate. The periphery can be flush with the edge of the rear part of the lower arcing horn or protrude slightly above the edge of the rear part of the lower arcing horn.

The invention also applies to non-limiting circuit breakers in which there is no articulation between a support cage and contact fingers, but a contact assembly forming an undeformable solid coupled to the mechanism.

The invention applies to both single-pole circuit breakers and multipole circuit breakers. The mechanism can be of any shape, with or without a switching bar. The bar, if it exists, can pivot around its longitudinal axis or around a distant geometric axis.

What is claimed is:

1. A pole for an electrical circuit breaker comprising a case and an operating mechanism able to switch from a closed position to an open position, said pole comprising:

a stationary contact means made of conducting material comprising a contact zone, a movable contact means comprising one or more contact fingers made of conducting material, the movable contact means being able to be coupled to said mechanism and to switch from a closed position in which the contact finger or fingers are in contact with the contact zone of the stationary contact means to an open position where the two contact means are separated, an arc extinguishing chamber comprising:

two parallel side flanges made of insulating material situated at equal distance from a geometric longitudinal mid-plane of the chamber, the longitudinal mid-plane thus bounding two geometric lateral half-spaces each containing one of the side flanges, a rear wall comprising one or more gas outlet orifices, separators extending from one of the side flanges to the other, appreciably perpendicularly to the longitudinal mid-plane, a front opening situated near to the contact zone of the stationary contact means and facing the rear wall, a lower arcing horn made of conducting material, electrically connected to the stationary contact means, comprising:

a rear part situated near to the rear wall and comprising an edge, an intermediate part joining the contact zone and the rear part, an upper arcing horn made of conducting material, the separators being situated between the lower arcing horn and the upper arcing horn, wherein:

the rear part has a width, measured parallel to an axis perpendicular to the longitudinal mid-plane, which is greater than the width of the intermediate part measured parallel to the same axis, in each of the lateral half-spaces, the rear part of the arcing horn has at least one point situated with respect to the side flange situated in the half-space involved at a distance which is smaller than a quarter of the distance between the two side flanges, the distance between the rear part and each of the side flanges is smaller than half the distance between each of the side flanges and the mid-plane, the edge of the rear part is bordered by a periphery made of gas-generating material which is interposed between the edge of the rear part and the side flanges.

2. The pole according to claim 1, wherein in each part of the chamber bounded by the longitudinal mid-plane, said point is also situated with respect to the rear wall at a distance which is smaller than a quarter of the distance between each of the side flanges.

* * * * *